US009594386B2

(12) United States Patent
Duan et al.

(10) Patent No.: US 9,594,386 B2
(45) Date of Patent: Mar. 14, 2017

(54) ADJUSTING CIRCUIT AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Yafeng Duan, Beijing (CN); Liguang Deng, Beijing (CN); Yingming Liu, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 14/365,861

(22) PCT Filed: Jun. 26, 2013

(86) PCT No.: PCT/CN2013/077956
§ 371 (c)(1),
(2) Date: Jun. 16, 2014

(87) PCT Pub. No.: WO2014/172990
PCT Pub. Date: Oct. 30, 2014

(65) Prior Publication Data

US 2015/0261233 A1 Sep. 17, 2015

(30) Foreign Application Priority Data

Apr. 26, 2013 (CN) ..... 2013 1 0150612

(51) Int. Cl.
*G05F 1/46* (2006.01)
*G09G 3/20* (2006.01)
*G09G 3/36* (2006.01)

(52) U.S. Cl.
CPC ..... *G05F 1/463* (2013.01); *G09G 3/20* (2013.01); *G09G 3/36* (2013.01); *G09G 3/3655* (2013.01);
(Continued)

(58) Field of Classification Search
CPC .. G05F 1/463; G09G 3/36; G09G 2320/0247; G09G 2320/041; G09G 3/20; G09G 3/3655
(Continued)

(56) References Cited

U.S. PATENT DOCUMENTS 5,351,003 A * 9/1994 Bauer ..... G01B 7/00 324/207.12
7,446,489 B2 * 11/2008 Jang ..... 315/309
(Continued)

FOREIGN PATENT DOCUMENTS

CN 202217488 5/2012

OTHER PUBLICATIONS

Wenhai Cui, Translation of CN202217488U, May 9, 2012.*
(Continued)

*Primary Examiner* — Dmitriy Bolotin
(74) *Attorney, Agent, or Firm* — Ladas & Parry LLP

(57) ABSTRACT

Embodiments of the present disclosure provide an adjusting circuit and a display device, which are capable of limiting a fluctuation of an output voltage ($V_{com}$) in the within a small range, weakening a flicker phenomenon and enhancing a display quality of a liquid crystal display. The adjusting circuit for the output voltage ($V_{com}$) comprises a voltage supplying module, a temperature sensing module and an
(Continued)

adjustment outputting module, wherein, the voltage supplying module is connected with the temperature sensing module and the adjustment outputting module, and is configured to provide input voltages to the temperature sensing module and the adjustment outputting module; the temperature sensing module is connected with the adjustment outputting module, and is configured to convert a temperature sensed into an electric signal and transmit the same to the adjustment outputting module; and the adjustment outputting module is configured to adjust an output voltage ($V_{com}$) according to the electric signal transmitted by the temperature sensing module, wherein the output voltage ($V_{com}$) fluctuates between an upper limit voltage and a lower limit voltage which are preset.

15 Claims, 4 Drawing Sheets

(52) U.S. Cl.
CPC ..... *G09G 2320/0247* (2013.01); *G09G 2320/041* (2013.01)

(58) Field of Classification Search
USPC .... 345/87–102, 204–214, 690–699; 327/513
See application file for complete search history.

(56) References Cited

U.S. PATENT DOCUMENTS 8,248,398 B2 * 8/2012 Cho et al. ..... 345/211
2009/0278832 A1 * 11/2009 Cho et al. ..... 345/211

OTHER PUBLICATIONS

International Search Report Issued Jan. 30, 2014; Appln. No. PCT/CN2013/077956.
First Chinese Office Action Appln. No. 201310150612.4; Dated Oct. 10, 2014.
Second Chinese Office Action dated Feb. 25, 2015; Appln. No. 201310150612.4.
Third Chinese Office Action dated Sep. 1, 2015; Appln. No. 201310150612.4.
International Preliminary Report on Patentability issued Oct. 27, 2015; PCT/CN2013/077956.

* cited by examiner

ADJUSTING CIRCUIT AND DISPLAY DEVICE

TECHNICAL FIELD

The present disclosure relates to a field of display technique, and more particularly, to an adjusting circuit and a display device.

BACKGROUND

In order to accomplish a design of a narrow bezel, an existing liquid crystal display generally utilizes a GOA (Gate Drive on Array) disposed on a substrate, instead of a traditional gate driving chip, to drive gate scan lines. The GOA circuit includes a great number of MOS transistors of TFT-type formed on the substrate, so its functional characteristics is easy to vary as the temperature changes, which leads to an unstable voltage $V_{gate}$ for driving the gate scan lines, and the unstable voltage $V_{gate}$ extra easily leads to a hopping of the voltage $V_{com}$, such that a very serious flicker phenomenon occurs. In generally, human's eyes can perceive the flicker if a flicker measured in percentage is higher than 10%, thus a display quality of a display device might be affected.

As known, usually a temperature compensation is performed on the $V_{gate}$ such that the degree of variation of the $V_{gate}$ with the temperature may be improved remarkedly, but such improvement can hardly affect the hopping of the $V_{com}$ and a high flicker in percentage still occurs, thus the display quality of the display device decreasing.

SUMMARY

Embodiments of the present disclosure provide an adjusting circuit and a display device, which are capable of limiting a fluctuation in the $V_{com}$ within a small range, weakening a flicker phenomenon and enhancing a display quality of a liquid crystal display.

The embodiments of the present disclosure utilize solutions as follows.

An adjusting circuit comprises a voltage supplying module, a temperature sensing module and an adjustment outputting module, wherein, the voltage supplying module is connected with the temperature sensing module and the adjustment outputting module, and is configured to provide input voltages to the temperature sensing module and the adjustment outputting module;

the temperature sensing module is connected with the adjustment outputting module, and is configured to convert a temperature sensed into an electric signal and transmit the same to the adjustment outputting module; and the adjustment outputting module is configured to adjust an output voltage $V_{com}$ according to the electric signal transmitted by the temperature sensing module, wherein the output voltage $V_{com}$ fluctuates between an upper limit voltage and a lower limit voltage which are preset.

Optionally, the temperature sensing module comprises a first thermistor unit and a second thermistor unit which are connected in series, wherein the first thermistor unit comprises at least one thermistor while the second thermistor unit comprises at least one thermistor.

Optionally, the adjustment outputting module comprises a first comparator, a second comparator and a digital-analog convertor; two inputting terminals of the first comparator are connected with two terminals of the first thermistor unit respectively, an outputting terminal of the first comparator is connected with a first inputting terminal of the digital-analog convertor, two inputting terminals of the second comparator are connected with two terminals of the second thermistor unit respectively, an outputting terminal of the second comparator is connected with a second inputting terminal of the digital-analog convertor; and an outputting terminal of the digital-analog convertor functions as an outputting terminal of the adjustment outputting module and outputs the voltage $V_{com}$.

Optionally, a threshold value of the first comparator and a threshold value of the second comparator are determined by the temperature sensing module as well as input voltages of the first and second comparators, such that, in the temperature sensing module, a voltage difference between the two terminals of the first thermistor unit reaches the threshold voltage of the first comparator at first and then a voltage difference between the two terminals of the second thermistor unit reaches the threshold voltage of the second comparator, as the temperature drops or rises.

The first comparator outputs a first level when the voltage difference between the two terminals of the first thermistor unit is greater than or equal to the threshold voltage of the first comparator, and outputs a second level otherwise; the second comparator outputs the first level when the voltage difference between the two terminals of the second thermistor unit is greater than or equal to the threshold voltage of the second comparator, and outputs the second level otherwise.

The digital-analog convertor outputs different values of the $V_{com}$ according to different digital input values.

Optionally, the temperature sensing module further comprises a third thermistor unit connected with the first thermistor unit and the second thermistor unit in series, wherein the third thermistor unit comprises at least one thermistor.

The adjustment outputting module further comprises a third comparator; the digital-analog convertor further comprises a third inputting terminal; two inputting terminals of the third comparator are connected with two terminals of the third thermistor unit respectively, and an outputting terminal of the third comparator is connected with the third inputting terminal of the digital-analog convertor.

Optionally, a threshold voltage of the third comparator is set such that a voltage difference between the two terminals of the third thermistor unit reaches the threshold voltage of the third comparator lastly as the temperature drops or rises; the third comparator outputs the first level when the voltage difference between the two terminals of the third thermistor unit is greater than or equal to the threshold voltage of the third comparator, and outputs the second level otherwise.

Optionally, the temperature sensing module further comprises an adjusting resistor unit including at least one resistor, which is configured to adjust the voltage differences between the corresponding two terminals of the respective thermistor units.

Optionally, at least one of the first thermistor unit, the second thermistor unit and the thermistor unit comprises a plurality of thermistors connected in parallel.

Optionally, the upper limit voltage is 1.0V and the lower limit voltage is −0.5V.

A display device comprises the above adjusting circuit.

Optionally, the adjusting circuit is integrated inside an integrated circuit board IC.

In the adjusting circuit and the display device according to the embodiments of the present disclosure, the variation in the temperature sensed is converted into the electric signal and transmitted to the adjustment outputting module by the temperature sensing module, so that the adjustment outputting module adjusts the output voltage $V_{com}$ according to the electric signal transmitted from the temperature sensing module, the output voltage $V_{com}$ fluctuates between the upper limit voltage and the lower limit voltage, thus the $V_{com}$ is enabled to fluctuate between the upper limit voltage and the lower limit voltage as the temperature changes and its fluctuation with the temperature is limited within a small range, which weakens the flicker phenomenon and enhances the display quality of the liquid crystal display.

REFERENCE SIGNS

1—voltage supplying module, 2—temperature sensing module, 3—adjustment outputting module, 21—first thermistor unit, 22—second thermistor unit, 23—adjusting resistor unit, 24—third thermistor unit, 31—first comparator, 32—second comparator, 33—digital-analog convertor, 34—third comparator.

DETAILED DESCRIPTION

Thereafter, solutions of embodiments of the present disclosure will be described clearly and completely in connection with drawings of the embodiments of the present disclosure, but obviously the described embodiments are only some of, and not all of the embodiments of the present disclosure.

Figure 1:
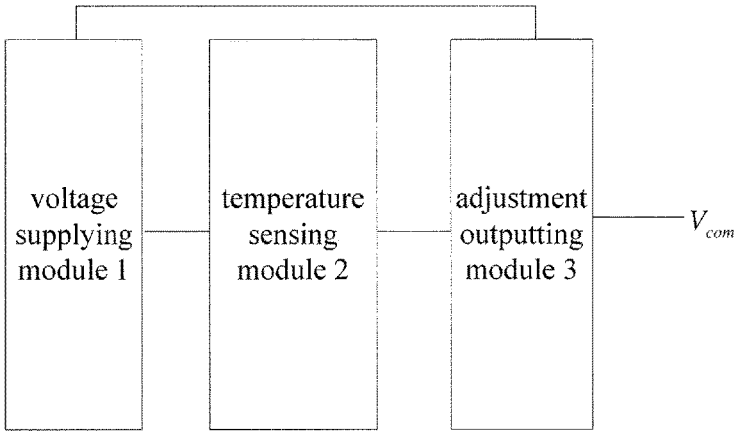
FIG. 1 is a block diagram illustrating a structure of an adjusting circuit according to embodiments of the present disclosure.

The embodiments of the present disclosure provide an adjusting circuit, as illustrated in FIG. 1, comprising a voltage supplying module 1, a temperature sensing module 2 and an adjustment outputting module 3, wherein, the voltage supplying module 1 is connected with the temperature sensing module 2 and the adjustment outputting module 3, and is configured to provide input voltages to the temperature sensing module 2 and the adjustment outputting module 3; the temperature sensing module 2 is connected with the adjustment outputting module 3, and is configured to convert a temperature variation sensed into an electric signal and transmit the same to the adjustment outputting module 3; and the adjustment outputting module 3 is configured to adjust an output voltage $V_{com}$ according to the electric signal transmitted by the temperature sensing module 2, wherein the output voltage $V_{com}$ fluctuates between an upper limit voltage and a lower limit voltage which are preset.

It should be noted that the output voltage $V_{com}$ in the embodiments of the present disclosure is inputted to a common electrode on an array substrate, the upper limit voltage and the lower limit voltage are obtained by actual product experiments, values of the upper limit voltage and the lower limit voltage ensures a fluctuation range of the outputted finally is small, that is, ensures a fluctuation range of a voltage at the common electrode is small, so that a flicker phenomenon, even if occurs, can not be perceived by human's eyes. Optionally, for a general display device, the upper limit voltage is set as 1.0V and the lower limit voltage is set as −0.5V.

In the adjusting circuit according to the embodiments of the present disclosure, the values of the $V_{com}$ can vary with the variations of the temperature, and a voltage variation range of the $V_{com}$ is between the upper limit voltage and the lower limit voltage, therefore its fluctuation is limited within a small range, so that the flicker phenomenon is weakened and the human's eye may perceive the flicker phenomenon hardly, and in turn the display quality of the liquid crystal display is enhanced.

Figure 2:
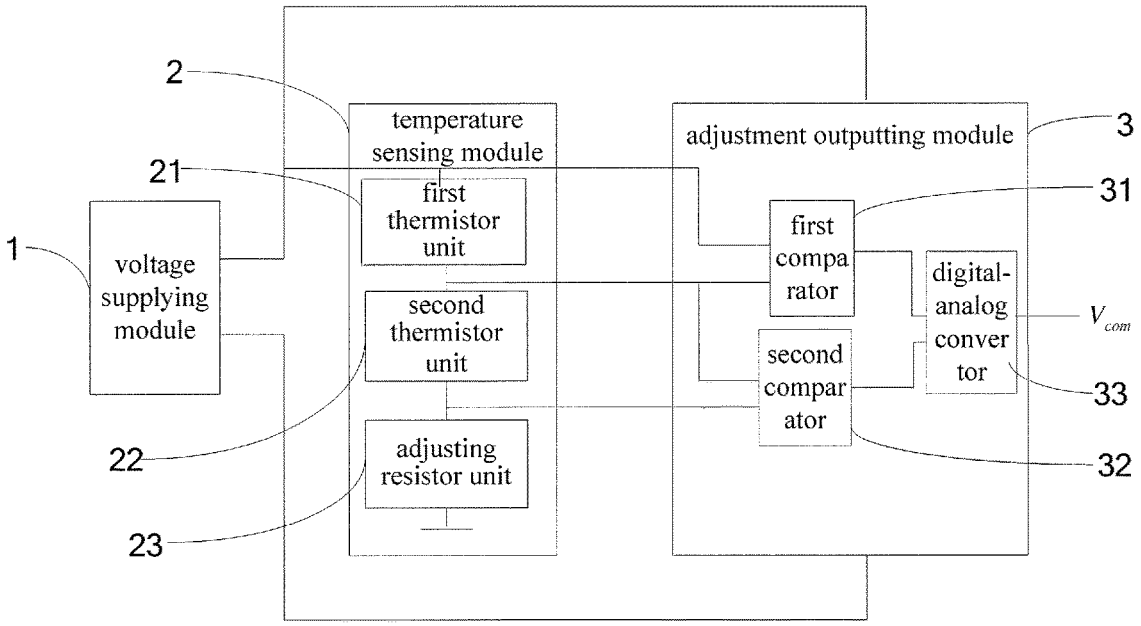
FIG. 2 is a block diagram illustrating a structure of another adjusting circuit according to the embodiments of the present disclosure.

Optionally, the adjusting circuit according to the embodiments of the present disclosure may be as illustrated in FIG. 2.

The temperature sensing module 2 comprises a first thermistor unit 21 and a second thermistor unit 22 which are connected in series, wherein the first thermistor unit 21 comprises at least one thermistor while the second thermistor unit 22 comprises at least one thermistor. Optionally, the adjustment outputting module 3 comprises a first comparator 31, a second comparator 32 and a digital-analog convertor 33; two inputting terminals of the first comparator 31 are connected with two terminals of the first thermistor unit 21 respectively, an outputting terminal of the first comparator 31 is connected with a first inputting terminal of the digital-analog convertor 33, two inputting terminals of the second comparator 32 are connected with two terminals of the second thermistor unit 22 respectively, an outputting terminal of the second comparator 32 is connected with a second inputting terminal of the digital-analog convertor 33; and an outputting terminal of the digital-analog convertor 33 is connected with the common electrode.

In the circuit shown in FIG. 2, the thermistor may present different resistances under different temperatures. The voltage supplying module 1 may provide the temperature sensing module 2 with the input voltage, that is, may apply a voltage across the first thermistor unit 21 and the second thermistor unit 22 connected in series. Thus the resistances of the first thermistor unit 21 and the second thermistor unit 22 would change when the temperature changes, and at this time, voltage values across the first thermistor unit 21 and the second thermistor unit 22 might also change.

In the temperature sensing module 2, the two terminals of the first thermistor unit 21 and the two terminals of the second thermistor unit 22 are connected with the first comparator 31 and the second comparator 32 respectively, so that the temperature sensing module 2 converts the change in temperature into a voltage signal and transmits the same to the adjustment outputting module 3.

In the adjustment outputting module 3, the two inputting terminals of the first comparator 31 and the two inputting terminals of the second comparator 32 are connected with the two terminals of the first thermistor unit 21 and the two terminals of the second thermistor unit 22 in the temperature sensing module 2 respectively. The first comparator 31 may compare a voltage difference between the two terminals of the first thermistor unit 21 with a threshold voltage of the first comparator 31, and outputs a value of 1 when the voltage difference between the two terminals of the first thermistor unit 21 is greater than or equal to the threshold voltage of the first comparator 31, and outputs a value of 0 otherwise. Similarly, The second comparator 32 may compare a voltage difference between the two terminals of the second thermistor unit 22 with a threshold voltage of the second comparator 32, and outputs a value of 1 when the voltage difference between the two terminals of the second thermistor unit 22 is greater than or equal to the threshold voltage of the second comparator 32, and outputs a value of 0 otherwise. It should be noted that the threshold values of the first comparator 31 and the second comparator 32 are determined according to the temperature sensing module 2 and their input voltages, such that, in the temperature sensing module 2, a voltage difference between the two terminals of the first thermistor unit 21 reaches the threshold voltage of the first comparator 31 at first and then a voltage difference between the two terminals of the second thermistor unit 22 reaches the threshold voltage of the second comparator 32, as the temperature drops or rises.

Therefore, under a normal temperature, both of the voltage difference between the two terminals of the first thermistor unit 21 and the voltage difference between the two terminals of the second thermistor unit 22 are within the corresponding threshold voltages of the respective comparators, and the outputs of the first comparator and the second comparator are 0, 0 respectively at this time. As the temperature drops, the voltage difference between the two terminals of the first thermistor unit 21 reaches the threshold voltage of the first comparator 31 at first, and the outputs of the first comparator and the second comparator are 1, 0 respectively at this time. As the temperature drops continually, the voltage difference between the two terminals of the second thermistor unit 22 also reaches the threshold voltage of the second comparator 32, and the outputs of the first comparator and the second comparator are 1, 1 respectively at this time. Values outputted from the first comparator 31 and the second comparator 32 are inputted to the digital-analog convertor 33 which can output different values for $V_{com}$ according to different digital input values. As an example, when the outputs of the first comparator and the second comparator, namely the input values of the digital-analog convertor 33, are 0, 0 respectively, the value of $V_{com}$ outputted from the digital-analog convertor 33 is VL; when the outputs of the first comparator and the second comparator, namely the input values of the digital-analog convertor 33, are 1, 0 respectively, the value of $V_{com}$ outputted from the digital-analog convertor 33 is VL-H; and when the outputs of the first comparator and the second comparator, namely the input values of the digital-analog convertor 33, are 1, 1 respectively, the value of $V_{com}$ outputted from the digital-analog convertor 33 is VH; wherein all of the VL, VL-H and VH are within the range between the upper limit voltage and the lower limit voltage, the VL may approach to the lower limit voltage, the VH may approach the upper limit voltage and the VL-H may be an arbitrary value between the VL and VH. Then the value of $V_{com}$ can be ensured to fluctuate within a small range as the temperature changes.

In the above embodiments, the corresponding comparator would output the value of 1 when the voltage difference between the two terminals of the thermistor unit is greater than or equal to the threshold voltage of the corresponding comparator, and output the value of 0, otherwise. Of course, obviously the corresponding comparator could also output the value of 0 when the voltage difference between the two terminals of the thermistor unit is greater than or equal to the threshold voltage of the corresponding comparator, and output the value of 1, otherwise, and the embodiments of the present disclosure are not limited thereto, as long as the comparator can output different values when a comparison between the input voltage of the comparator and the threshold voltage of the corresponding comparator changes.

Optionally, as illustrated in FIG. 2, the temperature sensing module 2 further comprises an adjusting resistor unit 23 including at least one resistor, connected with the respective thermistor units and configured to adjust the voltage differences between the corresponding two terminals of the respective thermistor units.

Figure 3:
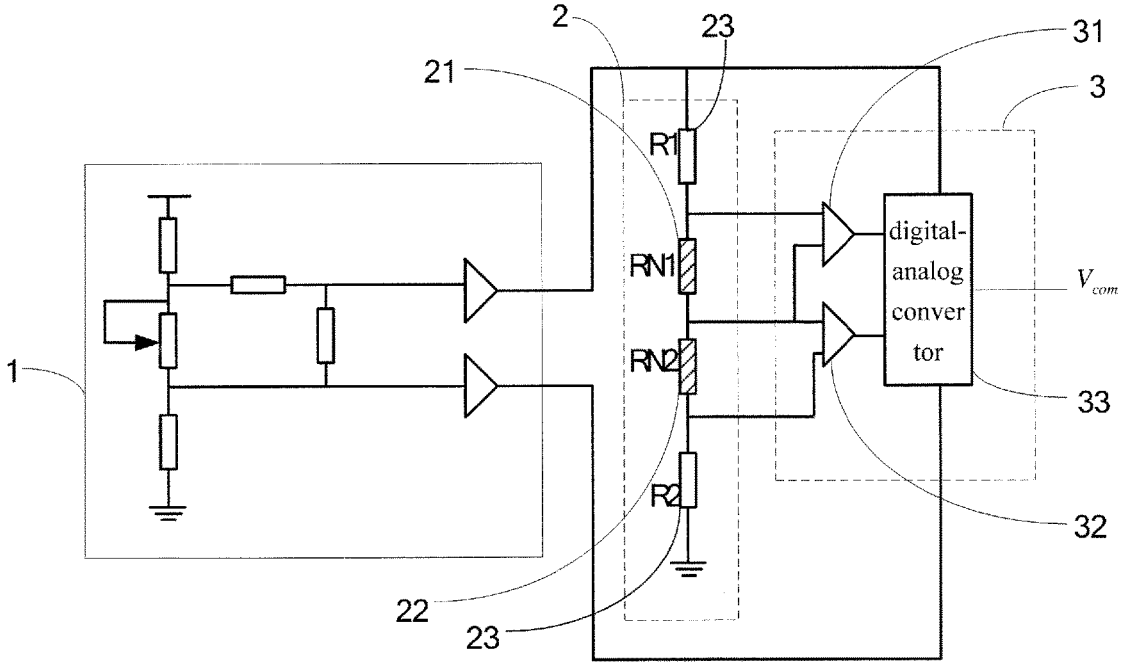
FIG. 3 is an exemplary view illustrating the adjusting circuit according to the embodiments of the present disclosure.
Figure 4:
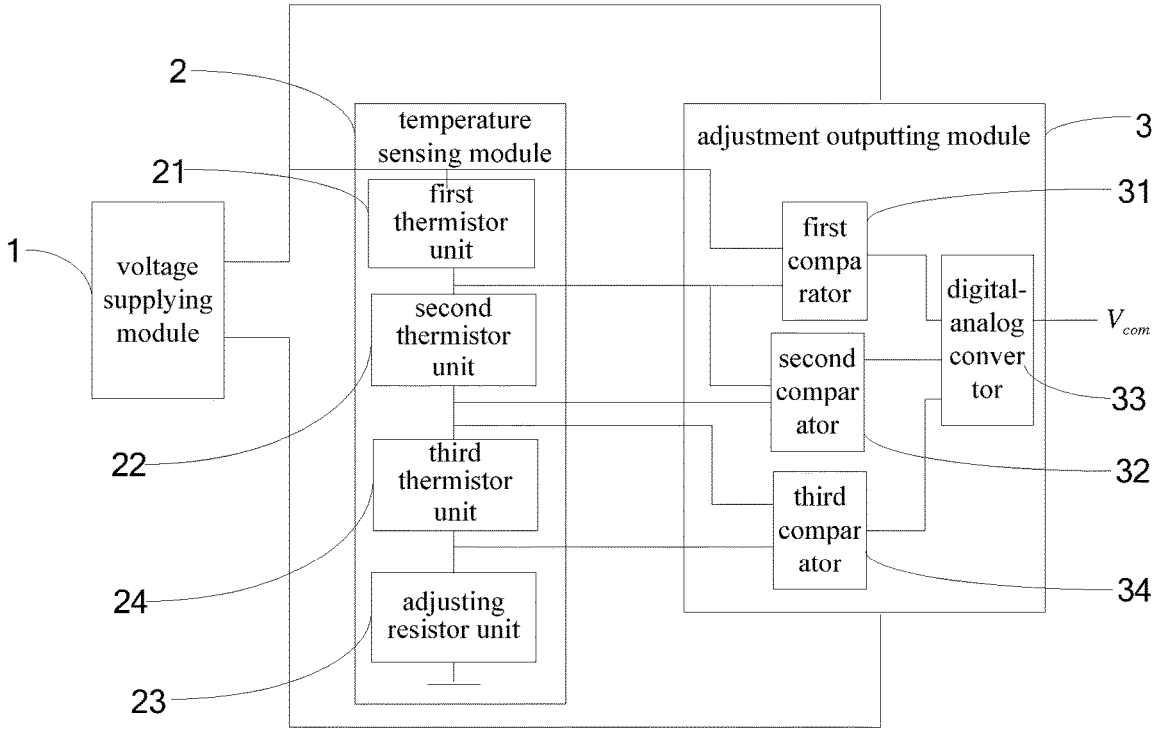
FIG. 4 is a block diagram illustrating a structure of another adjusting circuit according to the embodiments of the present disclosure.
Figure 5:
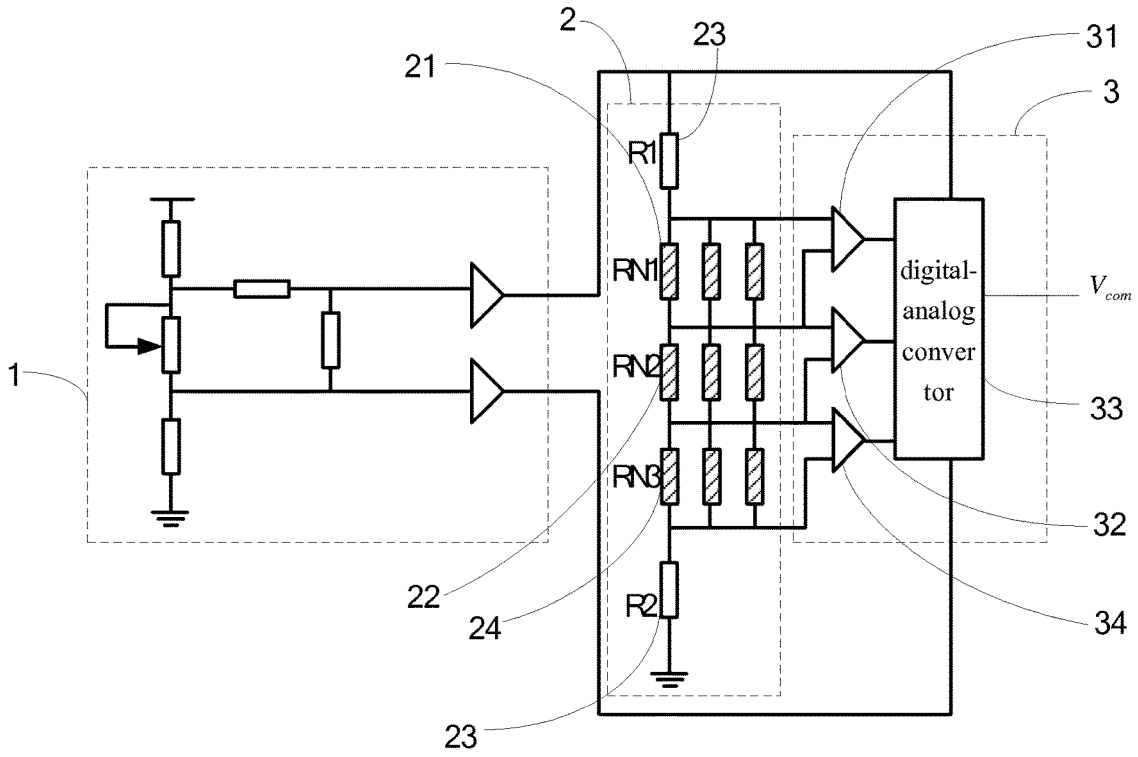
FIG. 5 is an exemplary view illustrating another adjusting circuit according to the embodiments of the present disclosure.

As an example, as illustrated in FIG. 3, which shows a detailed adjusting circuit according to the embodiments of the present disclosure, the adjusting circuit comprises a voltage supplying module 1 including various resistors, slide rheostats and operational amplifiers, which are connected in series or in parallel, as illustrated in FIG. 3. The voltage supplying module 1 of course may be another circuit structure with other type and is not limited thereto. The temperature sensing module 2 comprises the first thermistor unit 21, the second thermistor unit 22 and the adjusting resistor unit 23 connected in series, wherein the first thermistor unit 21 is a thermistor RN1, the second thermistor unit 22 is a thermistor RN2, and the adjusting resistor unit 23 comprises a R1 and a R2. The adjustment outputting module 3 comprises the first comparator 31, the second comparator 32 and the digital-analog convertor 33.

As the temperature changes, the output values of the first comparator 31 and the second comparator 32 would change when the voltage difference VRN1 between the two terminals of the first thermistor unit RN1 and the voltage difference VRN2 between the two terminals of the second thermistor unit RN2 change. Correspondingly, the value of $V_{com}$ outputted from the digital-analog convertor 33 would also change but the variation range of the $V_{com}$ value is within −0.5V~1.0V.

Taking two display devices as a comparison example, one of them is not equipped with the adjusting circuit shown in FIG. 3 while the other one is equipped with the adjusting circuit shown in FIG. 3. Under a condition of −70° C., the flickers in percentage of the two display devices are measured by an instrument and results are as shown as Table 1 below.

TABLE 1

| | | | | | | | | |
|---|---|---|---|---|---|---|---|---|
| flicker in percentage without adjusting circuit | 1.8 | 1.5 | 7.9 | 14.8 | 26 | 17 | 13.9 | 2.9 |
| flicker in percentage with adjusting circuit | 1.5 | 1.7 | 7.2 | 8.4 | 7.7 | 7.6 | 6.9 | 7.4 |

Under a condition of −40° C., the flickers in percentage of the two display devices are measured by an instrument and results are as shown as Table 2 below.

TABLE 2

| | | | | | | | | |
|---|---|---|---|---|---|---|---|---|
| flicker in percentage without adjusting circuit | 0.8 | 1.5 | 8.9 | 19.8 | 18 | 16 | 13 | 5.9 |
| flicker in percentage with adjusting circuit | 0.9 | 1.1 | 5.7 | 5.4 | 5.7 | 5.6 | 5.9 | 5.4 |

It can be known from the above two tables, in the display device without the adjusting circuit, the variations in the flicker in percentage is great under a same temperature, and some flicker in percentage is above 10% such that the human's eyes may perceive the apparent flicker phenomenon. As compared, in the display device with the adjusting circuit according to the embodiments of the present disclosure, the flicker in percentage occurred is stable and is always below 10%, so that the human's eyes can not find such slight flicker phenomenon. It can be seen that the adjusting circuit limits the fluctuation of the $V_{com}$ within a small range so as to weaken the flicker phenomenon and enhance the display quality of the liquid crystal display.

In the adjusting circuit for the $V_{com}$ voltage illustrated in FIG. 2 or 3, there only three cases in the input value of the digital-analog convertor: 00, 10 and 11, so there are only three corresponding cases in the output voltage $V_{com}$ of the digital-analog convertor. In order to increase a resolution of the digital-analog convertor and control the variation of the $V_{com}$ more precisely, the temperature sensing module in the adjusting circuit may further comprise a third thermistor unit 24 connected with the first thermistor unit and the second thermistor unit in series, wherein the third thermistor unit 24 comprises at least one thermistor. The adjustment outputting module further comprises a third comparator 34; the digital-analog convertor further comprises a third inputting terminal; two inputting terminals of the third comparator 34 are connected with two terminals of the third thermistor unit 24 respectively, and an outputting terminal of the third comparator 34 is connected with the third inputting terminal of the digital-analog convertor. A detailed structure diagram may be referred to FIGS. 2-5.

Optionally, a threshold voltage of the third comparator 34 is set such that a voltage difference between the two terminals of the third thermistor unit 24 reaches the threshold voltage of the third comparator 34 lastly as the temperature drops or rises; the third comparator 34 outputs the value of 1 when the voltage difference between the two terminals of the third thermistor unit 24 is greater than or equal to the threshold voltage of the third comparator 34, and outputs the value of 0, otherwise. Thus, the values outputted from the three comparators may be the values of 000, 100, 110 and 111; accordingly, the output voltage $V_{com}$ of the digital-analog convertor may also be four cases, which can increase the resolution of the digital-analog convertor and control the variation of the $V_{com}$ more precisely. Within a certain scope, the more the number of the values of $V_{com}$ is, the smaller the variation interval among the respective values of $V_{com}$ is, and the weaker the flicker phenomenon is, so that the display quality of the liquid crystal display can be further enhanced.

Of course, the temperature sensing module may comprise more thermistor units similarly and corresponding comparators may be added in the adjustment outputting module, so that the digital-analog convertor can have more input values so as to adjust the $V_{com}$ value more precisely. A circuit diagram illustrating such case may be similar to the FIG. 2 or 3, and its details are omitted herein.

Optionally, the first thermistor unit may comprise a plurality of thermistors connected in parallel. Of course the second thermistor unit may also comprise a plurality of thermistors connected in parallel. The plurality of thermistors connected in parallel may ensure a sensitivity of the corresponding thermistor units, and other paths of thermistors may be not affected if one path of the thermistors connected in parallel fails, which ensures a reliability of the circuit.

The embodiments of the present disclosure further provide a display device comprises the above adjusting circuit. The display device may be any product or device having the display function, such as a liquid crystal display panel, electric paper, an OLED panel, a mobile phone, a tablet computer, a TV, a display, a notebook computer, a digital photo frame, a navigator and the like.

Optionally, the adjusting circuit is integrated inside an integrated circuit board IC.

The above descriptions only illustrate the specific embodiments of the present invention, and the protection scope of the present invention is not limited to this. Given the teaching as disclosed herein, variations or substitutions, which can easily occur to any skilled pertaining to the art, should be covered by the protection scope of the present invention. Thus, the protection scope of the present invention is defined by the claims.

What is claimed is:

1. An adjusting circuit comprising a voltage supplying module, a temperature sensing module and an adjustment outputting module, wherein, the voltage supplying module is connected with the temperature sensing module and the adjustment outputting module, and is configured to provide input voltages to the temperature sensing module and the adjustment outputting module;

the temperature sensing module is connected with the adjustment outputting module, and is configured to convert a temperature sensed into an electric signal and transmit the same to the adjustment outputting module; and the adjustment outputting module is configured to adjust an output voltage ($V_{com}$) according to the electric signal transmitted by the temperature sensing module, where the output voltage fluctuates between an upper limit voltage and a lower limit voltage which are preset, wherein the temperature sensing module comprises a first thermistor unit and a second thermistor unit connected in series, wherein at least one of the first thermistor unit and the second thermistor unit comprises a plurality of thermistors connected in parallel so that the temperature sensing module has a hybrid connection of thermistors;

wherein the adjustment outputting module comprises a first comparator, a second comparator and a digital-analog convertor; two inputting terminals of the first comparator are connected with two terminals of the first thermistor unit respectively, and an outputting terminal of the first comparator is connected with a first inputting terminal of the digital-analog convertor; two inputting terminals of the second comparator are connected with two terminals of the second thermistor unit respectively, and an outputting terminal of the second comparator is connected with a second inputting terminal of the digital-analog convertor;

a threshold value of the first comparator and a threshold value of the second comparator are determined by the temperature sensing module having the hybrid connection of thermistors as well as the input voltages;

wherein the temperature sensing module further comprises a third thermistor unit connected with the first thermistor unit and the second thermistor unit in series, and third thermistor unit comprises at least one thermistor, the adjustment outputting module further comprises a third comparator; the digital-analog convertor further comprises a third inputting terminal; two inputting terminals of the third comparator are connected with two terminals of the third thermistor unit respectively, and an outputting terminal of the third comparator is connected with the third inputting terminal of the digital-analog convertor.

2. The adjusting circuit of claim 1, wherein an outputting terminal of the digital-analog convertor is configured as an outputting terminal of the adjustment outputting module and configured to output the voltage ($V_{com}$).

3. The adjusting circuit of claim 2, wherein in the temperature sensing module, a voltage difference between the two terminals of the first thermistor unit reaches the threshold voltage of the first comparator at first and then a voltage difference between the two terminals of the second thermistor unit reaches the threshold voltage of the second comparator, as the temperature drops or rises, the first comparator is configured to output a first level when the voltage difference between the two terminals of the first thermistor unit is greater than or equal to the threshold voltage of the first comparator, and to output a second level otherwise; the second comparator is configured to output the first level when the voltage difference between the two terminals of the second thermistor unit is greater than or equal to the threshold voltage of the second comparator, and to output the second level otherwise, the digital-analog convertor is configured to output different values of the output voltage ($V_{com}$) according to different digital input values.

4. The adjusting circuit of claim 1, wherein a threshold voltage of the third comparator is set such that a voltage difference between the two terminals of the third thermistor unit reaches the threshold voltage of the third comparator lastly as the temperature drops or rises; the third comparator is configured to output the first level when the voltage difference between the two terminals of the third thermistor unit is greater than or equal to the threshold voltage of the third comparator, and to output the second level otherwise.

5. The adjusting circuit of claim 1, wherein the temperature sensing module further comprises an adjusting resistor unit, wherein the adjusting resistor unit comprises at least one resistor and is connected with respective thermistor units in series, and is configured to adjust the voltage differences between the corresponding two terminals of the respective thermistor units.

6. The adjusting circuit of claim 1, wherein the third thermistor unit comprises a plurality of thermistors connected in parallel.

7. The adjusting circuit of claim 1, wherein the upper limit voltage is 1.0V and the lower limit voltage is −0.5V.

8. A display device comprises the adjusting circuit of claim 1.

9. The display device of claim 8, wherein the adjusting circuit is integrated inside an integrated circuit board IC.

10. The display device of claim 8, wherein an outputting terminal of the digital-analog convertor is configured as an outputting terminal of the adjustment outputting module and configured to output the voltage ($V_{com}$).

11. The display device of claim 10, wherein, in the temperature sensing module, a voltage difference between the two terminals of the first thermistor unit reaches the threshold voltage of the first comparator at first and then a voltage difference between the two terminals of the second thermistor unit reaches the threshold voltage of the second comparator, as the temperature drops or rises, the first comparator is configured to output a first level when the voltage difference between the two terminals of the first thermistor unit is greater than or equal to the threshold voltage of the first comparator, and to output a second level otherwise; the second comparator is configured to output the first level when the voltage difference between the two terminals of the second thermistor unit is greater than or equal to the threshold voltage of the second comparator, and to output the second level otherwise, the digital-analog convertor is configured to output different values of the output voltage ($V_{com}$) according to different digital input values.

12. The display device of claim 10, wherein a threshold voltage of the third comparator is set such that a voltage difference between the two terminals of the third thermistor unit reaches the threshold voltage of the third comparator lastly as the temperature drops or rises; the third comparator is configured to output the first level when the voltage difference between the two terminals of the third thermistor unit is greater than or equal to the threshold voltage of the third comparator, and to output the second level otherwise.

13. The display device of claim 10, wherein the third thermistor unit comprises a plurality of thermistors connected in parallel.

14. The display device of claim 8, wherein the temperature sensing module further comprises an adjusting resistor unit, wherein the adjusting resistor unit comprises at least one resistor and is connected with respective thermistor units in series, and is configured to adjust the voltage differences between the corresponding two terminals of the respective thermistor units.

15. The display device of claim 8, wherein the upper limit voltage is 1.0V and the lower limit voltage is −0.5V.

* * * * *